US006889682B2

(12) United States Patent
Styles et al.

(10) Patent No.: US 6,889,682 B2
(45) Date of Patent: May 10, 2005

(54) ELECTROPNEUMATIC PAINTBALL GUN, METHOD OF MAKING AND OPERATING, AND RETROFIT KIT ASSEMBLY

(76) Inventors: Leon Styles, 24632 Sadaba, Mission Viejo, CA (US) 92692; Jason Gardner, 2400 S. Manitoba, Santa Ana, CA (US) 92704

( * ) Notice: Subject to any disclaimer, the term of this patent is extended or adjusted under 35 U.S.C. 154(b) by 76 days.

(21) Appl. No.: 10/452,670

(22) Filed: May 30, 2003

(65) Prior Publication Data

US 2004/0237954 A1 Dec. 2, 2004

(51) Int. Cl.[7] ..... F41B 11/00
(52) U.S. Cl. ..... 124/77; 124/70
(58) Field of Search ..... 124/70, 71, 73, 124/74, 75, 76, 77

(56) References Cited

U.S. PATENT DOCUMENTS

| | | | | | |
|---|---|---|---|---|---|
| 3,741,189 | A | * | 6/1973 | Kester et al. | 124/76 |
| 5,063,905 | A | * | 11/1991 | Farrell | 124/72 |
| 5,462,042 | A | * | 10/1995 | Greenwell | 124/76 |
| 6,138,656 | A | * | 10/2000 | Rice et al. | 124/73 |
| 6,371,099 | B1 | * | 4/2002 | Lee | 124/66 |
| 6,532,949 | B1 | * | 3/2003 | McKendrick | 124/77 |
| 6,626,165 | B1 | * | 9/2003 | Bhogal | 124/77 |
| 6,637,420 | B2 | * | 10/2003 | Moritz | 124/73 |
| 6,694,963 | B1 | * | 2/2004 | Taylor | 124/32 |
| 6,701,908 | B2 | * | 3/2004 | Nibecker, Jr. | 124/69 |
| 2001/0042543 | A1 | | 11/2001 | Perrone | |
| 2002/0096164 | A1 | * | 7/2002 | Perrone | 124/77 |
| 2003/0000511 | A1 | * | 1/2003 | Moritz | 124/73 |
| 2003/0047175 | A1 | * | 3/2003 | Farrell | 124/76 |
| 2003/0066520 | A1 | | 4/2003 | Chang | |
| 2003/0079731 | A1 | * | 5/2003 | Dobbins | 124/76 |
| 2003/0106545 | A1 | * | 6/2003 | Verini | 124/74 |
| 2003/0230296 | A1 | * | 12/2003 | Farrell | 124/73 |

* cited by examiner

*Primary Examiner*—Jack Keith
*Assistant Examiner*—Troy Chambers
(74) *Attorney, Agent, or Firm*—Terry L. Miller

(57) ABSTRACT

An electro-pneumatically operated paint ball gun operates without the use of a mechanical sear, and includes a pneumatically operated hammer assembly effective to bump open a discharge valve and fire the gun. A programmable, microprocessor-based controller allows default values for time intervals of operation of the gun to be programmed, and also allows a user of the gun to access and change default values so that the operation of the gun can be modified to better meet the user's preferences. A cyclic rate of fire of as much as 30 paint ball shots per second or more is possible with a paint ball gun according to this invention. Further, a retrofit kit assembly provides for conversion of a conventional "autococker" type of paint ball gun into a gun embodying the present invention.

8 Claims, 5 Drawing Sheets

ELECTROPNEUMATIC PAINTBALL GUN, METHOD OF MAKING AND OPERATING, AND RETROFIT KIT ASSEMBLY

FIELD OF THE INVENTION

The invention relates to a pneumatic marker or paint ball gun, to a method of making and operating such a paint ball gun, and to a retrofit kit for converting a conventional paintball gun to embody the improved structure and operation of this invention.

BACKGROUND OF THE INVENTION

Paint ball guns were originally developed for marking uses such as forestry and cattle ranching, in which frangible projectiles or paint balls were fired against trees to be harvested or cattle to be taken to market, for example. For this reason, the paint ball guns themselves are frequently referred to as "markers." But, more recently paint ball guns are much more widely used in various recreational environments, such as simulated war games wherein it is the intent is to shoot at an opposing player with the paint ball gun, thus marking this opposing player with a particular color of paint from a frangible paint ball.

Paint ball guns using compressed air or gas for power are well known. Until recently, most paint ball guns were pneumatically powered, mechanically operated guns. The entry of electro-pneumatically operated paint ball guns provided more consistent and better performing guns for the recreational market. An electro-pneumatic paint ball gun provides improved performance with fewer component malfunctions than the earlier mechanical-pneumatic paint ball guns. However, a common problem with the conventional electro-pneumatic paint ball guns is that they use a mechanical sear device to release a hammer. The hammer is spring loaded to a position at which it impacts a valve stem, opening a flow path for high pressure gas to communicate to a paint ball, propelling the paint ball through and from a barrel of the gun. The adjustment of the engagement and release of the mechanical hammer and sear remains an uncertain element of conventional paint ball gun operation, requiring frequent adjustments in order to operate at high cyclic rates.

A more recent paint ball gun is shown in U.S. Pat. No. 6,532,949 (hereinafter, the "949" patent). In the '949 patent, a hammer of a paint ball gun is moved in each of two opposite directions by respective ends of a rod member, to which respective pneumatic pressures are applied sequentially by a solenoid valve. In this 949 patent, the hammer must be moved in each direction of its stroke by a respective pneumatic pressure, and these respective pneumatic pressures must be sequentially controlled by a solenoid valve.

SUMMARY OF THE INVENTION

In view of the deficiencies of the related art, it is an object for this invention to mitigate or eliminate at least one of these deficiencies.

Specifically, it is an object for this invention to provide a paint ball gun having no mechanical sear for releasing a hammer to discharge the paint gun.

Another object for this invention is to provide such a paint ball gun in which a hammer is pneumatically driven in one direction only to discharge the paint ball gun, and is driven in the opposite direction by a biasing spring in order to prepare the paint ball gun for its next discharge.

Still another object for this invention is to provide such a paint ball gun in which a microprocessor controller may be accessed by the user of the paint ball gun in order to fine tune the time sequence of events in the operation of the paint gun.

The present invention addresses the deficiencies of the conventional technology by providing an electro-pneumatically operated paint ball gun having a main body defining a first bore for receiving a paint ball. The first bore also receives a reciprocable bolt assembly which in respective first and second positions relative to the main body closes and opens a breech of the gun. A feed inlet opening to the first bore is provided for providing a supply of paint balls to the breech, and the main body further defines a second bore spaced below and substantially parallel with the first bore. A passage communicates from the second bore to the breech. A pneumatic discharge valve is disposed in the second bore, the pneumatic discharge valve including a seat member, and a poppet valve member sealingly engaging in a first position upon the seat member to close communication of pressurized gas from a source thereof to the breech via the passage. This poppet valve member includes a poppet valve stem extending through the seat member rearwardly of the gun. A pneumatic hammer assembly also is disposed in the second bore aft of the discharge valve, the pneumatic hammer assembly including a sleeve member defining a bore, a hammer member reciprocally and sealingly movable in the sleeve member bore and cooperating therewith to define a variable-volume chamber having a minimum volume with the hammer member in a first position. A spring is disposed in the second bore between the pneumatic hammer assembly and the pneumatic discharge valve and biases the hammer member to the first position. The hammer member in response to receipt of pressurized gas in the sleeve bore moves axially forwardly of the gun to a second position to abut the poppet valve stem, thus unseating the poppet valve member to a second position and opening the discharge valve to communicate pressurized gas to the breech via the passage.

Additional objects and advantages of the present invention will become apparent to those ordinarily skilled in the pertinent arts upon reading the following detailed description of a particularly preferred embodiment of the invention, which illustrates the best mode contemplated for practicing the invention, taken in conjunction with the accompanying drawings.

DETAILED DESCRIPTION OF THE PREFERRED EMBODIMENT

Figure 1:
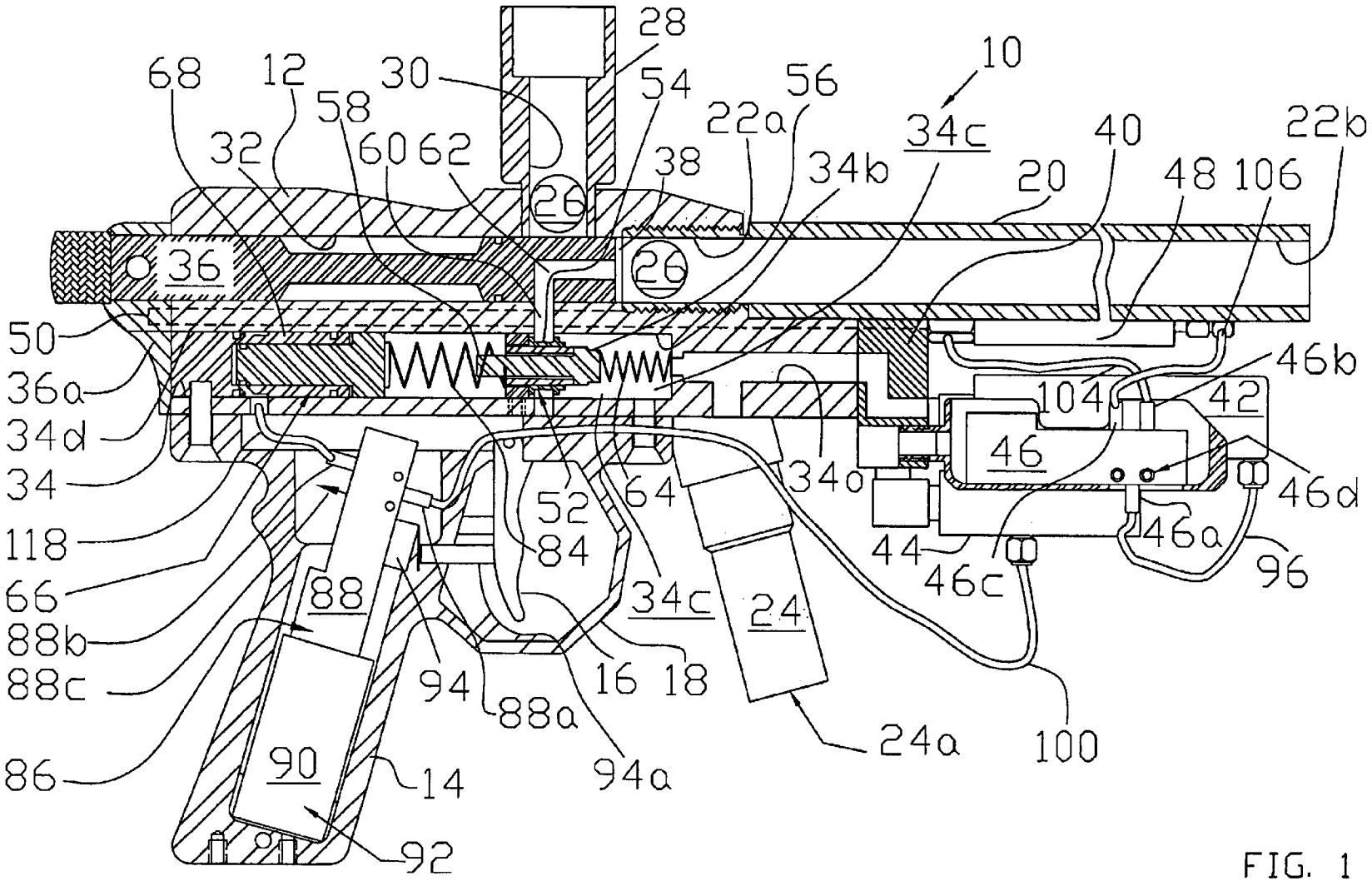
FIG. 1 is a side elevation view, partially in cross section, of a paint ball gun embodying the present invention, and shows the paint ball gun in the condition it has immediately preparatory to filing a paint ball.

Referring to the drawing Figures in conjunction with one another, and first considering especially FIG. 1, a paint ball gun 10 includes a main body 12, with a grip frame 14 pivotally carrying a trigger 16 and defining a trigger guard 18. A barrel 20 is attached to the main body 12, and defines a breech opening 22*a* by which a paint ball is received, and muzzle opening 22*b* by which a paint ball is discharged. A gas inlet regulator body 24 is also attached to the main body 12, and provides communication via an inlet 24*a* (arrowed on FIG. 1) with a source of high pressure gas (not shown in the drawing Figures) for powering the paint ball gun 10.

A paint ball hopper and feeding device (also not seen in the drawing Figures) can be mounted on the top of the main body 12, feeding paintballs 26 into the gun 10 via an upper feed tube 28 defining a feed port 30. The feed port 30 opens into a top one 32 of two substantially parallel and vertically spaced bores (i.e., bores 32 and 34) defined by the main body 12. The barrel 20 is received at a rear portion thereof into the front of bore 32, and is able to receive and discharge the paint balls 26. A bolt assembly 36 is reciprocally and sealingly received into the rear portion of bore 32, and cooperates with the feed port 30 and with the barrel 20 at breech opening 22*a* to define a breech chamber 38 in which a paint ball is sealingly received and is held until it is forcefully discharged from the gun 10, viewing FIG. 1.

Figure 5:
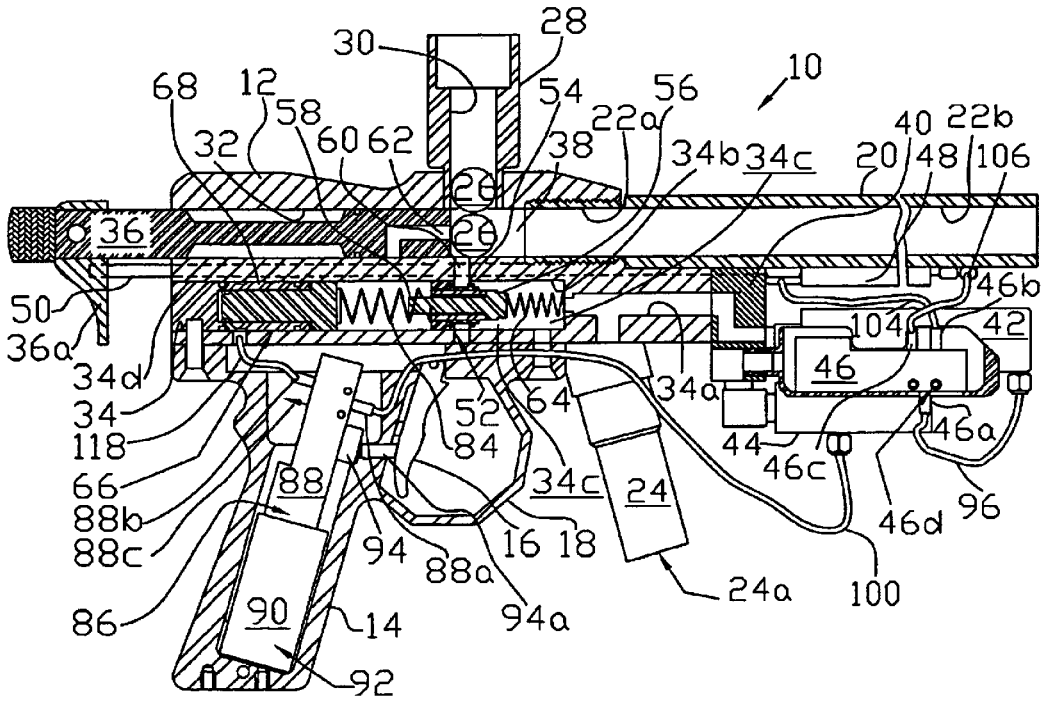
FIG. 5 is a side elevation view similar to FIGS. 1–4, also partially in cross section, and shows the paint ball gun in the condition it has next in sequence after that of FIG. 4, and during which a new paint ball is loaded into the breech of the gun.

The gas inlet regulator 24 provides pressurized gas (i.e., compressed air, nitrogen, or carbon dioxide, for example) into a bore portion 34*a*. A front part of the bore portion 34*a* communicates via a manifold piece 40 (which sealingly closes this bore at the front of the gun 10) with a pair of low-pressure pressure regulators 42 and 44. Also mounted to the manifold piece 40 is a 4-way solenoid valve assembly 46, and a dual-acting pneumatic cylinder or ram 48. The ram 48 has an internal piston (not shown in the drawing Figures) connecting operably to a reciprocable link rod 50. The link rod 50 extends rearwardly of the gun 10 (i.e., leftwardly viewing the drawing FIGS. 1–6) to connect operably to a back block part 36*a* of bolt assembly 36. Thus, a portion of the bolt assembly 36 is reciprocable selectively in bore 32 under control of the ram 48 and 4-way solenoid valve 46 to move the bolt assembly between the closed position seen in FIG. 1 and the opened position seen in FIG. 5. As is seen in FIG. 5, a paint ball 26 is received via the feed port 30 into the breech chamber 38 when the bolt assembly 36 is fully opened.

Returning to a consideration of FIG. 1, it is seen that the bore portion 34*a* also communicates rearwardly to a larger diameter bore portion 34*b*, which serves to define a volume accumulator or chamber 34*c*, storing a quantity of pressurized gas in preparation for firing of the gun 10. A discharge valve assembly 52 is sealingly received in the bore 34 aft of the bore portion 34*b*, and includes a seat member 54 movably receiving a poppet valve member 56. The poppet valve member 56 includes an elongate stem portion 58 extending rearwardly through the seat member 54. The seat member 54 also defines a flow passage 60 communicating via a passage 62 defined by the housing 12 between the bores 32 and 34, to communicate pressurized gas from chamber 34*c* via a passage 36*b* of the bolt assembly 36 and to the breech chamber 38 when the poppet valve member 56 is unseated, as will be further explained below. A coil spring 64 yieldably urges the poppet valve member 56 into sealing engagement with the seat member 54.

Figure 3:
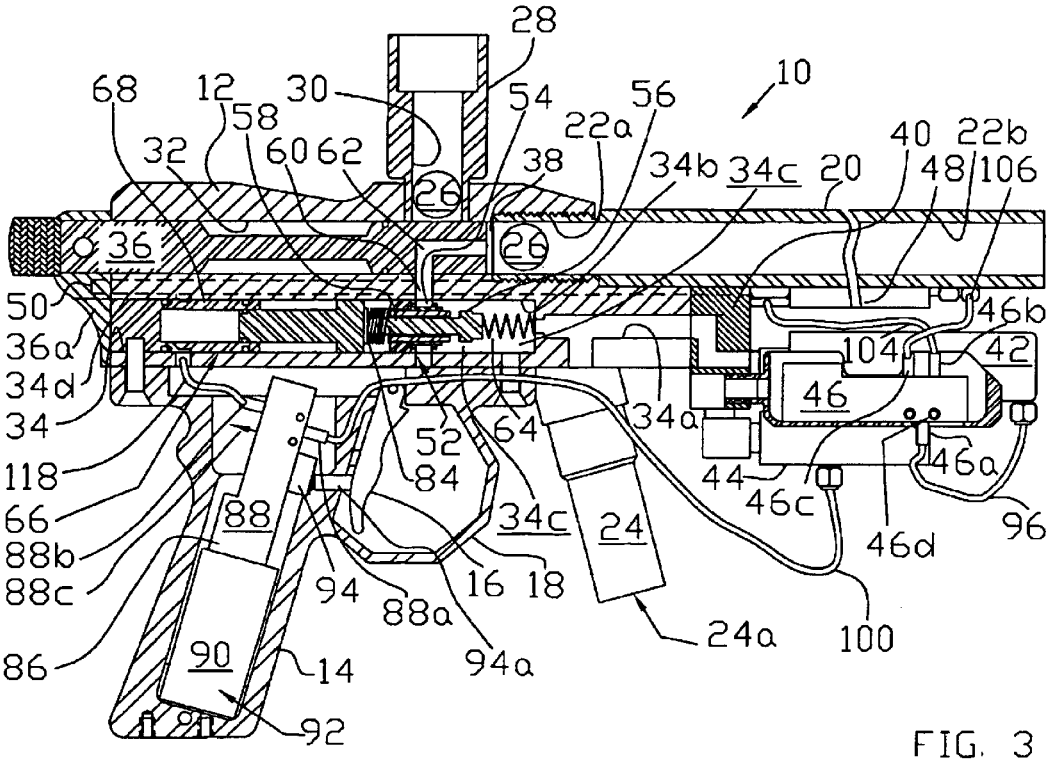
FIG. 3 is a side elevation view similar to FIGS. 1 and 2, also partially in cross section, and shows the paint ball gun in the condition it has at the moment pressurized gas is communicated to a paint ball within the barrel of the gun, thus to fire this paint ball from the barrel.
Figure 3A:
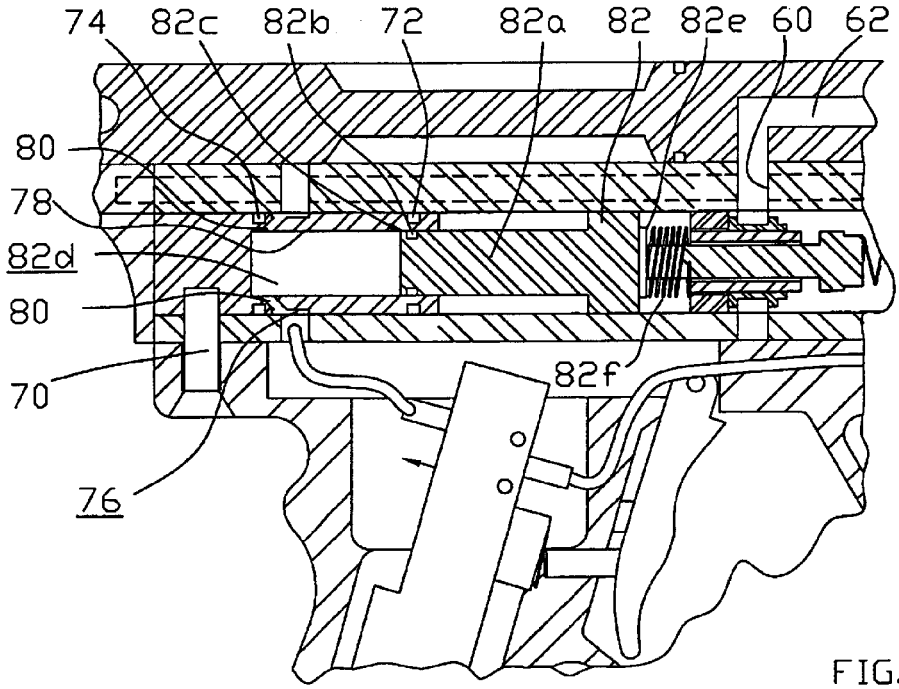
FIG. 3A is an enlarged fragmentary view of a portion of FIG. 3.
Figure 4:
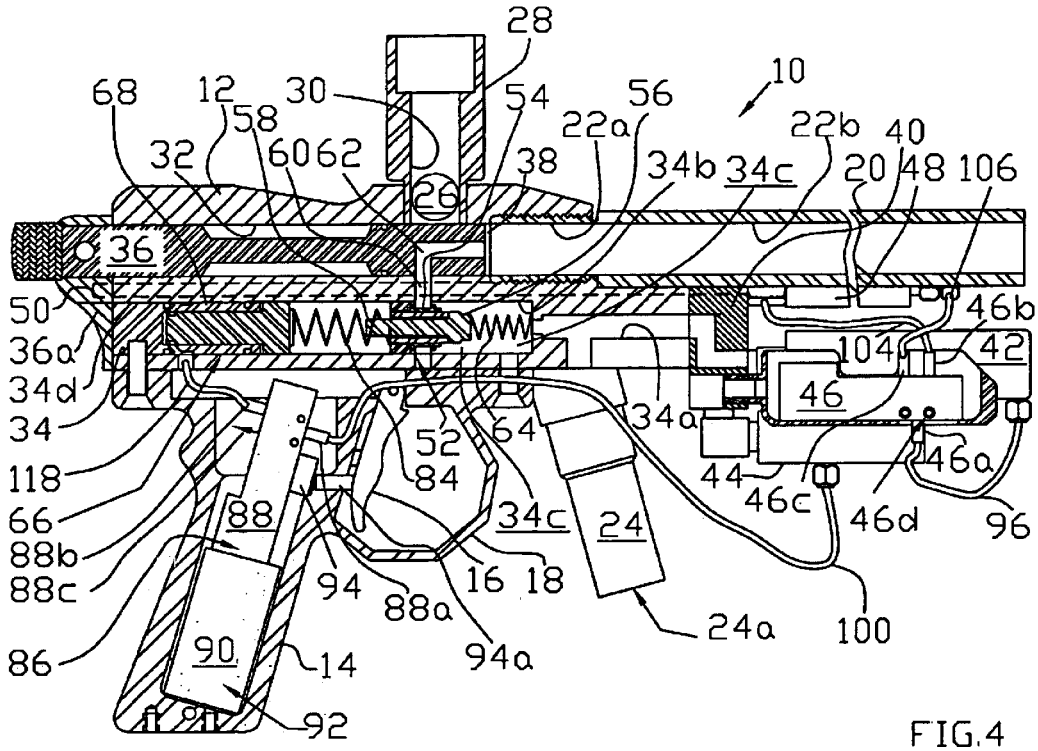
FIG. 4 is another side elevation view similar to FIGS. 1–3, and is also partially in cross section, and shows the paint ball gun in the condition it has next in sequence after the condition of FIG. 3.

Also received into the bore 34 at an aft portion 34*d* thereof is a pneumatic hammer assembly 66. The details of this pneumatic hammer assembly are best viewed in FIGS. 1 and 3, and especially in FIG. 3*a*. This pneumatic hammer assembly 66 includes a sleeve member 68 sealingly received into the bore portion 34*d*, and which is there retained in this aft bore portion 34*d* by a radially extending screw 70 (not seen in the drawing Figures, but indicated by an arrowed reference number) extending through an aligning hole in the housing 12 and threadably engaging into the sleeve member 68. This sleeve member includes a pair of spaced apart seal members 72 and 74, which cooperatively bound an annular chamber 76 therebetween. Within the sleeve member 68 is defined a blind bore 78 opening forwardly on the sleeve member within bore portion 34*d*. A multitude of ports 80 open from the annular chamber 76 into the bore 78 adjacent the aft end (i.e., the blind end) thereof.

Reciprocally received into the bore 78 is the aft end portion 82*a* of a hammer member 82. The aft end portion 82*a* defines a seal groove 82*b*, and carries a seal member 82*c* which is sealingly movable within the sleeve member 68. The aft end portion 82*a* cooperates with the sleeve member 68 to define an expansible chamber 82*d*. The ports 80 communicate with chamber 82*d*. This hammer member 82 also includes an enlarged hammer head portion 82*e* disposed outwardly (i.e., forwardly) of the sleeve member 68 and within bore portion 34*d*. At the forward end of this hammer member 82, the hammer head portion 82*b* defines an abutment surface 82*f* In the first position of the hammer member 82 seen in FIG. 1, the abutment surface is spaced from valve stem 58. However, as is seen in FIG. 3, the hammer member 82 is movable to a second position (FIGS. 3 and 3*a*) to abut on stem 58 at abutment surface 82*f*, thus unseating the poppet valve member 56 and opening the discharge valve 52. A coil spring 84 is received into bore portion 34*d* between the seat member 52 and the head 82*e* of hammer member 82 in order to yieldably urge or bias the hammer member 82 to its first position, as is seen in FIGS. 1, 2, and 4–6.

Further considering the drawing Figures, it is seen that the grip frame 14 houses an electronic and valving assembly 86. This assembly 86 includes a 3-way, normally closed solenoid valve, indicated with the numeral 88. The solenoid valve 88 has an inlet port 88*a*, an outlet port 88*b* communicating to port 88*a* when the valve is energized, and an outlet port 88*c* to ambient (indicated by the arrowed numeral on the drawing Figures), communicating with port 88*b* when the valve 88 is de-energized. Assembly 86 also includes a circuit board 90 including a microprocessor based control system, indicated with arrowed numeral 92, and more particularly disclosed in FIG. 8. A switching device 94 is arranged to be activated by rearward movement of the trigger 16 (i.e., by means of an interposed push rod 94*a*) so as to discharge the gun 10, as is further explained below. It is to be noted that while the switching device 94 is depicted in the present embodiment as including or being a micro-switch, the invention is not so limited. For example, an electro-optical switching device may be alternatively employed.

Further considering the drawing Figures, it is seen that the regulator 42 provides pressurized gas to a conduit or line 96 which extends to a normally open common port 46*a* of the 4-way solenoid valve 46. From regulator 44 a line 100 extends to the normally closed port 88*a* of the 3-way solenoid valve 88. A line 104 extends from a normally open port 46*b* of the solenoid valve 46 to the rear connection of ram 48, thus normally urging the ram, link rod, and bolt assembly 36 forwardly. From a normally closed port 46*c* of the solenoid valve 46 a line 106 extends to a front connection at the ram 48. The solenoid valve 46 includes a vent port 46*d* to ambient (indicated by the arrowed numeral on the drawing Figures), and to which the port 46*c* communicates when the solenoid 46 is de-energized, while the port 46*b* communicates to vent port 46*d* when the solenoid is energized.

Figure 8:
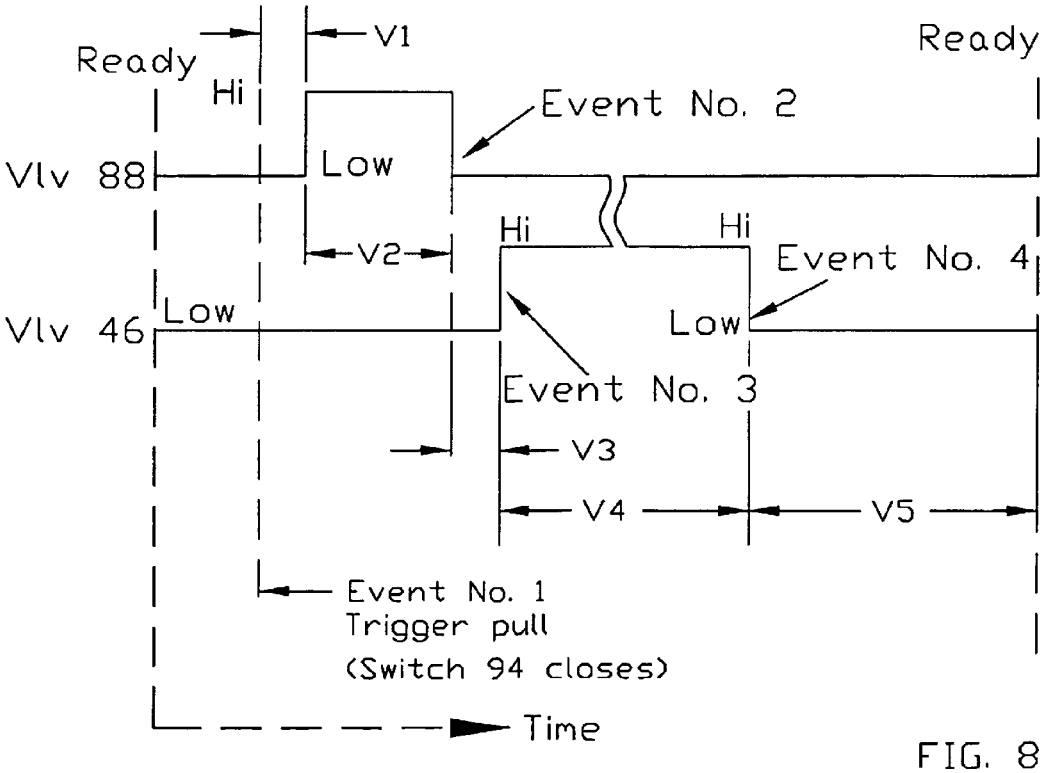
FIG. 8 is a diagrammatic representation of a microprocessor control system of the present inventive paint ball gun, which controls its operation and which also allows for fine tuning of timing of events in the sequence of operation of the gun in order to maximize the operation characteristics of particular guns and best suit the wishes of particular shooters.

Turning now to FIG. 8, details of the microprocessor control system 92 included in the assembly 86 is presented with more particularity. This system 92 includes a microprocessor 108, with associated memory 110, and an input facility or interface 112. The processor 108 also includes an output facility or interface 114. The input facility 112 receives an input from the switch 94, responsive to rearward movement of the trigger 16. This input facility can also receive an input (indicated with arrowed numeral 116) from an electric "eye" (i.e., from a light emitting diode and photodiode or phototransistor combination) installed at the breech chamber 38 and responsive to the presence of a paint ball) so that the bolt assembly 36 is not closed on a paint ball that is in the feed port 30, but which is not yet completely received into the chamber 38. Such an electric eye is conventional, and is not illustrated in the drawing Figures. However, it is to be understood that the use of such an eye prevents the bolt assembly 36 closing too early and cutting or fracturing a paint ball that is only partially fed into the gun 10. Those ordinarily skilled in the pertinent arts will know that the rate of feeding of individual paint balls via port 30 will depend in part upon whether the operator of the gun 10 is utilizing a simple gravity feed paint ball hopper, or perhaps is using an electric feed paint ball hopper which provides a feeding assistance to the paint balls entering port 30. Thus, the feed rate of paint balls via port 30 is a variable, to which the gun 10 is responsive, as will be further explained.

Further considering FIG. 8, it is seen that the input facility 112 also includes a port 118 by which a user of the gun 10 may access the timing functions of the control system 92, so as to fine tune those timing functions to the user's preferences. As FIG. 8 illustrates, the controller 92 has output connections via the output facility 114 to each of the solenoid valves 46 and 88 so as to control the operations and timing of these solenoid valves, thus to control operation of the gun 10. As those ordinarily skilled in the pertinent arts will understand, the output facility may provide output interface connections with other functions of the gun 10, such as control of a stirring function of a paint ball hopper feeding paint balls to the gun 10.

Figure 6:
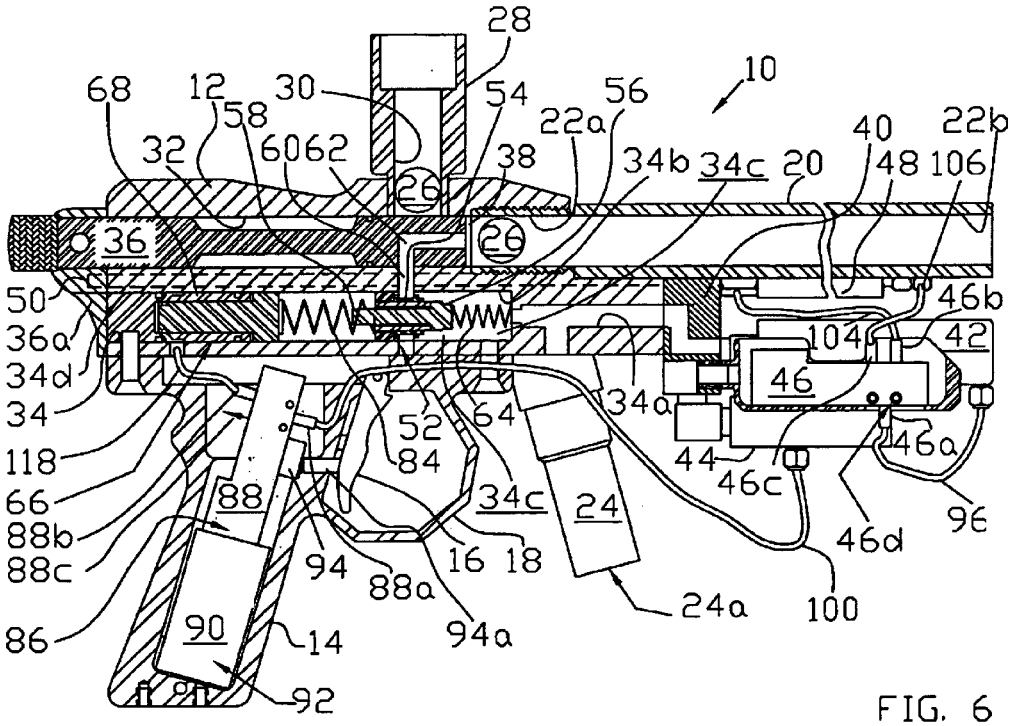
FIG. 6 is yet another side elevation view similar to FIGS. 1–5, and is also partially in cross section, and shows the paint ball gun in the condition it has next in sequence after the condition of FIG. 5, which will complete a cycle of operation, bringing the paint ball gun to the condition seen in FIG. 1.
Figure 7:
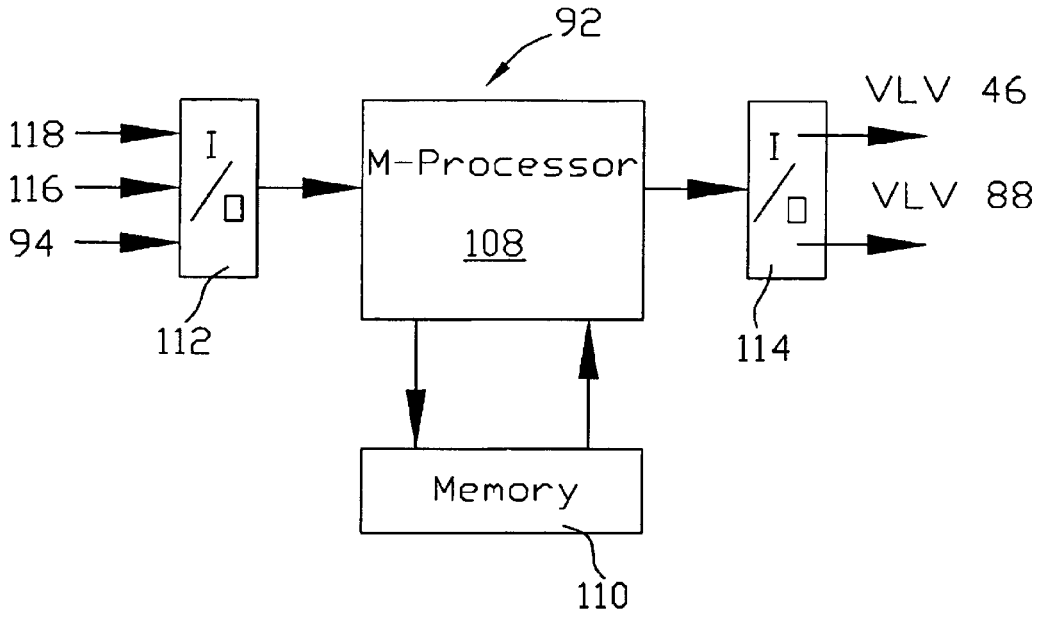
FIG. 7 is a timing diagram of the operation of the paint ball gun seen in FIGS. 1–6.

Finally, considering FIG. 7, and referring also to FIGS. 1–6, it will be seen that the operation of the gun 10 is as follows: With a source of high pressure gas connected to the inlet 24*a* of the gas inlet regulator 24, with a supply of paint balls 26 provided to the feed tube 28, and with the controller 92 energized (i.e., by an on-board battery, for example) the gun 10 is ready for shooting. In preparation for such shooting, the operator can place a first paint ball 26 into the breech chamber 38 by manually grasping the knurled portion of the back block part 36*a* and cycling the bolt assembly 36 rearwardly and then back forward to place a paint ball from feed port 30 into chamber 38, preparing the gun 10 for the condition of FIG. 1. In this condition of FIG. 1, both solenoid valves 46 and 88 are de-energized, and the bolt assembly is urged forward by pressurized gas communicating to line 104 and to the rear connection of the ram 48. The hammer member 83 is also in its first position of FIG. 1. This is the "ready" condition seen at the margins of FIG. 8.

Figure 2:
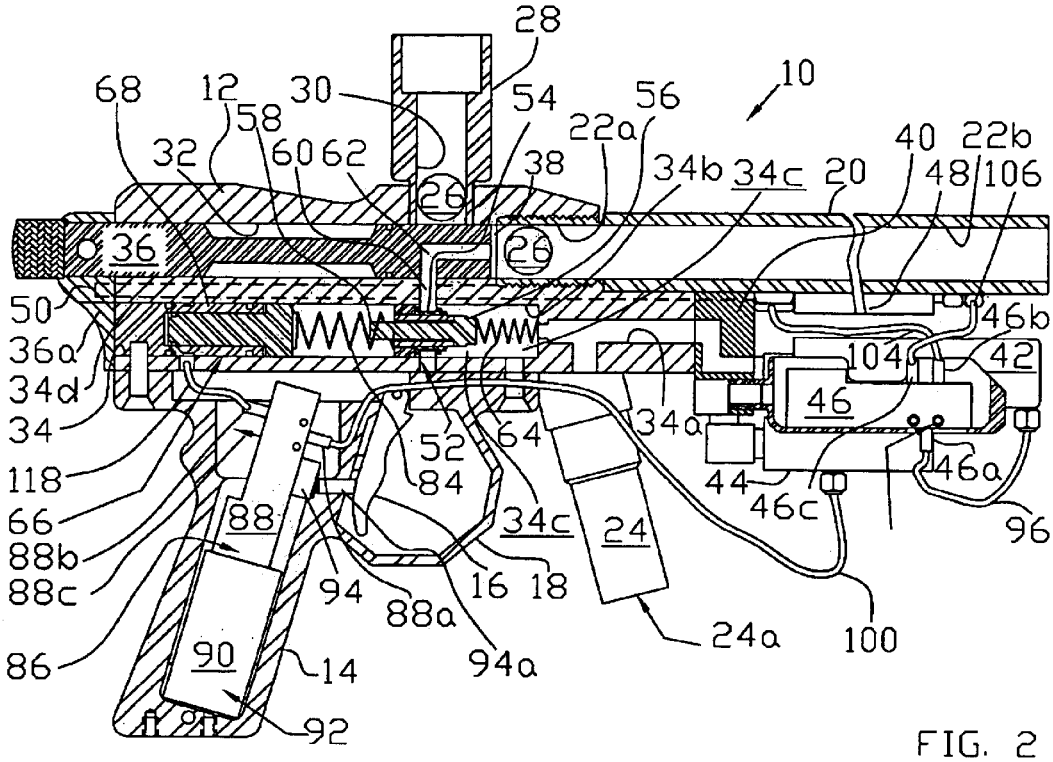
FIG. 2 is a side elevation view similar to FIG. 1, and also partially in cross section, and shows the paint ball gun in the condition it has immediately after the moment the trigger is pulled in order to fire a paint ball.

Considering FIG. 2, and further considering the timing diagram of FIG. 8, when the trigger 16 is pulled by the operator (indicated as event No. 1 on FIG. 8), the control system 92 energizes solenoid valve 88, with this valve requiring a time interval (indicated as V1, or variable 1, on FIG. 8) to switch pressurized gas from port 88*a* to port 88*b*. The variable V1 is expected to be from about 1 millisecond to about 5 millisecond, and is substantially repeatable for a particular gun because it represents the response time of valve 88. The pressurized gas communicated to port 88*b* is communicated via a line 118 from port 88*b* (indicated by the arrows on FIG. 2) to chamber 76, through the ports 80, and into chamber 82*d*.

Thus, this pressurized fluid acting on the pneumatic hammer assembly 66 moves the hammer member 82 to its second position, and "bumps" open the poppet valve member 56 of discharge valve 52, communicating pressurized gas from chamber 34*c* to the breech chamber 38 via the seat member 54, passage 60 and passage 62.

Pressurized gas communicating to the breech chamber 38 discharges the paint ball 26 from the gun 10 along barrel 20 (viewing particularly FIG. 3). But, viewing FIG. 8 once again, it is seen that the time interval V2 during which the solenoid valve 88 is energized is variable also. The time interval V2 may be programmed into the processor system 92 with a default value providing positive operation of the firing action of the gun 10. However, the time interval V2 may also be accessed by a user of the gun 10 (i.e., via interface 118) in order to vary this time interval as the user wishes in order to maximize performance of the particular gun 10.

Next, viewing FIG. 8, it is seen at event No. 2, the solenoid 88 is de-energized, which closes communication of pressurized gas to port 88*b*, and communicates pressurized gas from chamber 82*d* to ambient via the vent port 88*c*. This allows the spring 84 to move hammer member 82 toward its first position, and allows discharge valve 52 to close, so that residual pressure within the breech chamber 38 and barrel 20 begins to decay as pressurized fluid flows from the muzzle of the gun 20 following discharge of the paint ball 26. This is the condition of the gun 10 depicted particularly by FIG. 4.

While this pressure decay in the breech chamber 38 and barrel 20 is taking place, a time interval V3 is counting down. Time interval V3 will be programmed to a default value, expected to be from about 0 (zero) millisecond to about 5 millisecond. But, time interval V3 may also be accessed by a user of the gun 10 so that the operation of a particular gun 10 can be adjusted to the user's preferences.

At the end of time interval V3, event No. 3 (FIG. 8) is initiated by the controller 92. At the moment indicated at event No. 3 on the diagram of FIG. 8, the solenoid valve 46 is energized, switching pressurized gas from the rear of ram 48 to the front of ram 48. Thus, the link rod 50 is forced rearwardly, and the bolt assembly 36 is moved rearwardly, viewing FIG. 5. At the full rearward position of the bolt assembly 36, a paint ball 26 may enter via feed port 30 and be received into breech chamber 38. The time interval required for the bolt assembly to move from its closed position of FIGS. 1–4, to its filly opened position of FIG. 5, and for a paint ball 26 to be received into breech chamber 38 via feed port 30 will vary dependent on a multitude of factors, as was mentioned earlier. For example, a gravity feed of paint balls will likely be much slower than a power feed.

Also, in this respect it is important to note that immediately after a shot, the residual pressure in the breech chamber 38 is positive (i.e., well above ambient), but this pressure decays rapidly as pressurized gas flows from the muzzle. If the bolt 36 is opened too early while the positive pressure is still present, this positive pressure can resist the entry of the next paint ball 26 into the breech chamber 38. However, after the positive pressure wave flows from the muzzle of the gun 10, this positive pressure is followed by a rarefaction wave (i.e., negative pressure wave) that moves along the barrel 20 from the muzzle toward the breech chamber 38. If the bolt 36 is opened in synchronization with the arrival of this negative pressure wave at the breech chamber 38, then the next paint ball 26 can be assisted into the breech chamber by the negative pressure wave. One factor that will influence the time of arrival of the negative pressure wave at the breech chamber 38 is the length of the barrel 20.

Subsequently, the time interval V4 counts down, viewing FIG. 8. The value of time interval V4 is programmed to a default value, but if the gun 10 is operating with an input 116 to controller 92 (i.e., from an electric eye sensing the presence of a paint ball in breech chamber 38) then the time interval V4 ends when this input 116 is provided. Again, the default value of time interval V4 may be accessed and changed according to the preferences of a particular user of the gun 10.

At the completion of time interval V4, at event No. 4, the solenoid valve 46 is de-energized, and switches pressurized gas from the front of ram 48 to the rear of this ram, beginning the closing motion of bolt assembly 36. As is seen in FIG. 6, once the bolt assembly 38 is fully closed with a new paint ball 26 in the breech chamber 38, the gun 10 will have returned to its "ready" condition, prepared to fire yet another paint ball shot. However, as FIG. 8 illustrates, the time interval V5 required for the full closing of the bolt assembly 38 may take from about 5 millisecond to about 30 millisecond. Thus, the time interval V5 is also programmed to a default value insuring reliable operation of the gun 10, but may also be accessed and adjusted by a user of the gun 10 in order to tune the gun to the user's preferences.

Further to the above, and with consideration of the timing diagram of FIG. 8, it is important to understand that a paint ball gun according to this invention may achieve a cyclic rate of as much as 30 firing operations or more per second. Thus, dependent upon the type of paint ball feed being employed, the skill of the operator in dithering the trigger 16, and the timing factor "tuning" of a particular paint ball gun, the gun 10 may fire paint ball shots essentially like a fully automatic gun, at a cyclic rate of as much as 30 shot a second or more.

That is, as described, the gun is set up for semi-automatic operation but it can readily be converted to select fire or fully automatic operation in which the electronic control circuit 92 continuously repeats the firing cycle whilst the trigger 16 is actuated. In this case the rate of fire will depend solely on the length of the firing cycle.

Still further with consideration of FIG. 8, it is to be noted that by accessing and adjusting the values (i.e., time intervals) of the time periods indicated as V1, V2, and V3, an operator of the gun 10 may time the gun so that the rarefaction wave arrives at the breach of the gun at the optimum time to ingest the new paint ball 26. That is, the new paint ball can be literally sucked into the breach of the gun 10 (in assistance to gravity or such other feeding force as may be provided by an auto-feed device, for example). It is to be remembered that the opening movement of the bolt assembly 38 takes some short period of time after event No. 3, but this time period is repeatable. Thus, the time period from the trigger pull (event No. 1) until the bolt 38 reaches its full open position is repeatable, and the relative timing of the opening of discharge valve 52 (i.e., the event that really starts the positive pressure wave in the gun 10, resulting in an inverting reflection at the muzzle, and the rarefaction wave then moving to the breach) until the bolt assembly 38 is open and receives the next paint ball 26, can be precisely tuned using the present invention. Thus, this invention provides the possibility of precisely opening the bolt assembly 38 in synchronization with the arrival at the breach of a rarefaction wave ingesting the next paintball, which could not heretofore be achieved.

Further, this invention provides a retrofit kit assembly (or kit of parts) for converting a conventional paint ball gun of the "over and under" bore design having a mechanical sear, and being commonly referred to as an "autococker" into a gun embodying the present invention. This retrofit kit of parts includes a new grip frame 14 with trigger 16 and trigger guard 18, and having the internal electronics and valving assembly 86 installed. As was disclosed above, the electronics and valving assembly 86 includes circuit board 90. This circuit board 90 carries microprocessor-based control system 92, as well as the trigger switch 94. Also included in the retrofit kit of parts is the 4-way solenoid valve 46, and a sufficient length of the conduit material for the various interconnecting pneumatic lines as depicted and disclosed above. Also, this retrofit kit of parts includes the pneumatic hammer assembly 66, with sleeve member 68 and hammer member 82. One or both of the regulators 44 and 46 may be included in the retrofit kit, depending on the preferences of the user and the cyclic rate of fire that is desired from the converted gun.

Thus, the present invention provides for a retrofit kit assembly that can be easily connected to a conventional "autococker" type of paint ball gun body. The autococker type of paint ball gun bodies have the "over and under" bore design as depicted and described above. This retrofit kit of parts may be utilized along with the conventional parts of such an autococker paint ball gun in order to change a conventional gun (which conventionally is of mechanical 30 pneumatic operation) into the better performing, electro-pneumatic and sear-less operation of the present invention.

While the invention has been described in connection with what is presently considered to be the most practical and preferred embodiment, it is to be understood that the invention is not to be limited to the disclosed embodiments but is intended to be limited only by the spirit and scope of the appended claims, giving full cognizance to equivalents, and to cover various modifications and equivalent arrangements as is permitted under the law.

What is claimed is:

1. An electro-pneumatically operated paint ball gun, said paint ball gun having a main body defining a first bore for receiving a paint ball, said first bore also receiving a reciprocable bolt assembly which in respective first and second positions relative to said main body closes and opens a breech of said gun, a feed inlet opening to the first bore for providing a supply of paint balls to said breech, said main body further defining a second bore spaced below and substantially parallel with said first bore, and a passage for communicating pressurized gas from said second bore to said breech;

a pneumatic discharge valve disposed in said second bore, said pneumatic discharge valve including a seat member, and a poppet valve member sealingly engaging in a first position upon said seat member to close communication of pressurized gas from a source thereof to said breech via said passage, said poppet valve member including a poppet valve stem extending through said seat member rearwardly of said gun;

a pneumatic hammer assembly also disposed in said second bore aft of said discharge valve, said pneumatic hammer assembly including a sleeve member defining a bore, a hammer member reciprocally and sealingly movable in said sleeve member bore and cooperating there with to define a variable volume chamber having a minimum volume with said hammer member in a first position, a spring disposed in said second bore between said pneumatic hammer assembly and said pneumatic discharge valve and biasing said hammer member to said first position, said hammer member in response to receipt of pressurized gas in said sleeve bore being movable axially forwardly of said gun to a second position to abut said poppet valve stem, thus unseating said poppet valve member to a second position and opening said discharge valve to communicate pressurized gas to said breech via said passage.

2. The paint ball gun of claim 1 further including a pneumatic ram having a piston and a rod connecting with said bolt assembly for moving said bolt assembly between said first and second positions in response to respective pneumatic pressures applied to said piston; a pair of solenoid valves each receiving pressurized gas from a source thereof; and one of said pair of solenoid valves communicating pressurized gas selectively to said ram to apply said first and second pneumatic pressures thereto, thus controllably effecting opening and closing of the breech of said paint ball gun by said bolt assembly; a second of said pair of solenoid valves communicating pressurized gas selectively to said pneumatic hammer assembly to controllably effect movement of said hammer member between its first and second positions.

3. The paint ball gun of claim 2 further including a programmable controller selectively controlling said first and second solenoid valves.

4. The paint ball gun of claim 3 wherein said programmable controller effects a first programmable time interval between an event starting movement of said hammer member from its first position toward its second position, and a next subsequent event starting movement of said hammer member from its second position back toward its first position.

5. The paint ball gun of claim 4 wherein said programmable controller effects a second programmable time interval between said second event starting movement of said hammer member from its second position back toward its first position, and a third event starting movement of said bolt assembly from its first closed position toward its second opened position.

6. The paint ball gun of claim 5 wherein said gun further includes a barrel member of determined length for discharge of said paintball and having a characteristic frequency of air pressure wave oscillation therein between a breach opening and a muzzle opening of said barrel member, and said first time interval and said second time interval in total are selectable in order to synchronize opening of said bolt assembly and the arrival at said breach opening of said barrel member of a rarefaction air pressure wave, thus assisting a new paint ball into said breach opening.

7. The paint ball gun of claim 3 wherein said programmable controller includes a microprocessor, an input from a trigger member of said gun for initiating a firing cycle of the gun, and an output to each of said first and second solenoid valves.

8. A paintball gun having a high cyclic rate of fire, said paintball gun including a main gun body defining a pair of parallel bores disposed vertically one above the other, the upper bore receiving a forwardly extending barrel including a breach opening and a muzzle opening, and the gun body defining a feed port communicating a supply of paintballs with said breach opening, a reciprocable bolt assembly received into said first bore and being reciprocable between respective closed first position and an opened second position relative to said main gun body to close and open said breech of said gun;

said main gun body further providing at a lower one of said pair of parallel bores a passage for communicating pressurized gas from said lower bore to said breech to discharge a paint ball along said barrel from the gun; and in said lower bore a pneumatic discharge valve including a seat member and a poppet valve member sealingly engaging in a first position upon said seat member to close communication of pressurized gas from a source thereof to said breech via said passage, said poppet valve member having a poppet valve stem extending through said seat member rearwardly of said gun; and a pneumatic hammer assembly also disposed in said lower bore aft of said discharge valve and including a sleeve member defining a bore, a hammer member reciprocally and sealingly movable in said sleeve member bore and cooperating therewith to define a variable-volume chamber having a minimum volume with said hammer member in a first position, a spring in said second bore between said pneumatic hammer assembly and said pneumatic discharge valve to bias said hammer member to said first position, and valve means for providing a pneumatic pressure signal into said variable volume chamber to move said hammer member axially forwardly of said gun to a second position to abut said poppet valve stem unseating said poppet valve member to a second position and opening said discharge valve to communicate pressurized gas to said breech via said passage.

* * * * *